United States Patent [19]

Conti

[11] 4,322,012

[45] Mar. 30, 1982

[54] THREADED PLASTIC BOTTLE CAP

[75] Inventor: Vincent N. Conti, West Hempstead, N.Y.

[73] Assignee: Dairy Cap Corporation, Jamaica, N.Y.

[21] Appl. No.: 148,555

[22] Filed: May 9, 1980

[51] Int. Cl.[3] ..... B65D 53/00

[52] U.S. Cl. ..... 215/344; 215/252; 215/DIG. 1; 215/329

[58] Field of Search ..... 215/252, 256, 329, 344, 215/DIG. 1

[56] References Cited

U.S. PATENT DOCUMENTS

| | | | |
|---|---|---|---|
| 2,162,712 | 6/1939 | Hamberger | 215/252 |
| 2,965,256 | 12/1960 | Yochem | 215/252 |
| 3,053,406 | 9/1962 | Wandell | 215/344 X |
| 3,074,579 | 1/1963 | Miller | 215/344 |
| 3,255,907 | 6/1966 | Eddy | 215/344 |
| 3,281,000 | 10/1966 | Lowen | 215/344 |
| 3,329,295 | 7/1964 | Fields | 215/252 |
| 3,370,732 | 2/1968 | La Vange | 215/252 |
| 3,435,975 | 4/1969 | Weigand | 215/344 |
| 3,441,161 | 4/1969 | Van Baarn | 215/235 |
| 3,494,496 | 2/1970 | Livingstone | 215/252 |
| 3,737,064 | 6/1973 | Patel et al. | 215/252 |
| 3,901,404 | 8/1975 | Feldman | 215/344 X |
| 3,904,062 | 9/1975 | Grussen | 215/252 |
| 4,033,472 | 7/1977 | Aichinger | 215/252 |
| 4,061,240 | 12/1977 | Brownbill | 215/270 |
| 4,090,631 | 5/1978 | Grussen | 215/344 X |
| 4,143,785 | 3/1979 | Ferrell | 215/DIG. 1 |
| 4,147,268 | 4/1979 | Patel et al. | 215/252 |
| 4,171,749 | 10/1979 | Obrist et al. | 215/256 |
| 4,196,818 | 4/1980 | Brownbill | 215/252 |

*Primary Examiner*—George T. Hall

*Attorney, Agent, or Firm*—Pennie & Edmonds

[57] ABSTRACT

A plastic bottle cap for use in sealing bottles, the cap having a first annular sealing flange engaging the internal wall surface of the bottle and a second annular sealing flange engaging the top surface of the bottle neck. The second flange is constructed with a flexible tip which flexes relative to the remaining portion of the second flange as it is engaged by the top of the bottle neck to produce a flapper type seal. The cap further includes a tamper-proof ring at its bottom end which is automatically torn away as the cap is unthreaded from the bottle.

7 Claims, 4 Drawing Figures

THREADED PLASTIC BOTTLE CAP

TECHNICAL FIELD

The invention relates to a plastic threaded cap for bottles containing liquid under vacuum or pressure.

BACKGROUND ART

Bottle caps for carbonated beverages have for many years been constructed of metal. These caps are either crimped to the neck of the bottle or threaded onto the bottle. More recently the industry has turned to the use of plastic caps constructed either for a snap fit onto the bottle or threaded engagement with cooperating threads on the neck of the bottle. Plastic caps of the threaded construction are either designed for use with glass bottles or plastic bottles. The former use requires internal sealing configurations which can accommodate imperfections usually found in the top of the neck of glass bottles as resulting during their manufacturing or caused by rough handling. A typical plastic cap design for glass bottles is disclosed in U.S. Pat. No. 4,090,631. Although specifically constructed for glass bottles, these caps can also be used for plastic bottles. However, their construction is of such intricate design that the molding dies have to be correspondingly intricate. This in turn makes the molds subject to damage of the delicate parts during handling.

In constructing plastic caps as opposed to metal caps, more attention has to be given to the internal sealing flanges found on these caps so as to provide a suitable sealing of the contents in the bottle. This is more difficult with plastic caps because of their inherent physical characteristics which tend to permit the sealing effect to be lost during handling and storage of the bottles. In the use of plastic caps, there has also been encountered what is called the projectile effect which is caused by the cap providing too good a seal with the bottle neck. Where this occurs, the pressure within the bottle is not released until the cap is almost completely unthreaded. At this time, the internal pressure, instead of being released gradually, is released just at the time the cap is completely unthreaded and this causes the cap to be blown off the bottle with some force. This is particularly a problem where plastic caps are used with plastic bottles because plastic bottles do not have the usual inperfections that glass bottles have.

Although the imperfections in a glass bottle may promote problems as far as obtaining a good seal, these same imperfections help to eliminate the projectile effect since the pressure within the bottle can usually be released while the cap is still adequately threaded onto the bottle. The precision molding of plastic bottles does not produce these imperfections and thus the seal of the cap tends to be maintained until just before the cap is fully removed.

U.S. Pat. Nos. 3,441,161 and 4,143,785 disclose caps constructed of plastic and adapted to be attached to bottles either by snap fit or threaded connection. These patents, however, disclose no provisions for assuring harmless release of the pressure built up in the bottle. The bottle cap disclosed in U.S. Pat. No. 4,090,631 does disclose a cap which is constructed to release the pressure within the bottle before reaching the state where the cap would be subjected to being blown off by the internal pressure. As mentioned, however, this cap is of intricate construction as is the mold from which it is formed.

The caps disclosed in these patents also rely mainly on face-to-face contact of the cap with the opposed surfaces of the bottle for maintaining a seal. With plastic caps, simple surface contact does not at all times provide a seal which is adequate. This is mainly due to the absence of a resiliency of the seal at the cap bottle sealing interface.

DISCLOSURE OF THE INVENTION

In accordance with the teachings of the present invention, applicant has developed a threaded plastic cap of a construction which is particularly suited for effecting an efficient and stable seal while the bottle is being handled and stored. In addition, the seal is oriented so as to be released upon the initial unthreading of the cap from the bottle. The cap of the present invention is particularly suited for bottles constructed of plastic.

In construction, sealing is produced by two flanges depending downwardly from the top of the cap. One of these flanges effects a seal with the inner wall surface of the neck of the bottle while the second flange effects a seal on the top of the bottle neck around its outer periphery. This second flange is constructed to flex at its tip as it engages the top of the bottle neck so that this seal will always be resiliently biased against the top of the bottle neck as opposed to simply having the surface-to-surface contact found with prior art constructions. The two flanges are spaced from each other and with the intermediate area of the top of the cap provide a chamber which is isolated from the interior of the bottle. The void created by this chamber further assists in the sealing of the cap to the bottle.

Upon removal of the cap from the bottle, the second flange immediately releases its sealing effect while the sealing effectiveness of the inner seal is gradually reduced as the cap is unthreaded. This permits escape of pressure before the cap reaches a point where it will be blown off of the bottle.

The cap of the present invention further includes a tamper-proof ring secured at its lower end. This tamper-proof ring is constructed with cam surfaces for riding over a cooperating protuberance on the bottle neck until engaged underneath the protuberance as the cap is fully threaded onto the neck. The tamper-proof ring is frangibly connected to the remaining portion of the cap so that it will break upon unthreading.

DETAILED DESCRIPTION OF THE INVENTION

Figure 1:
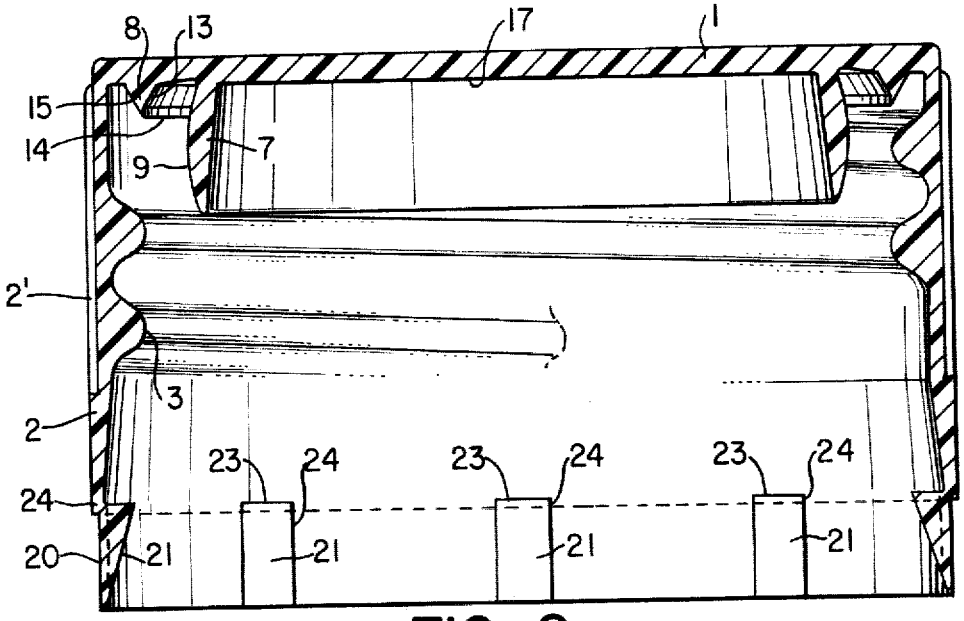
FIG. 1 is an enlarged cross-sectional view of the cap of the present invention.
Figure 2:
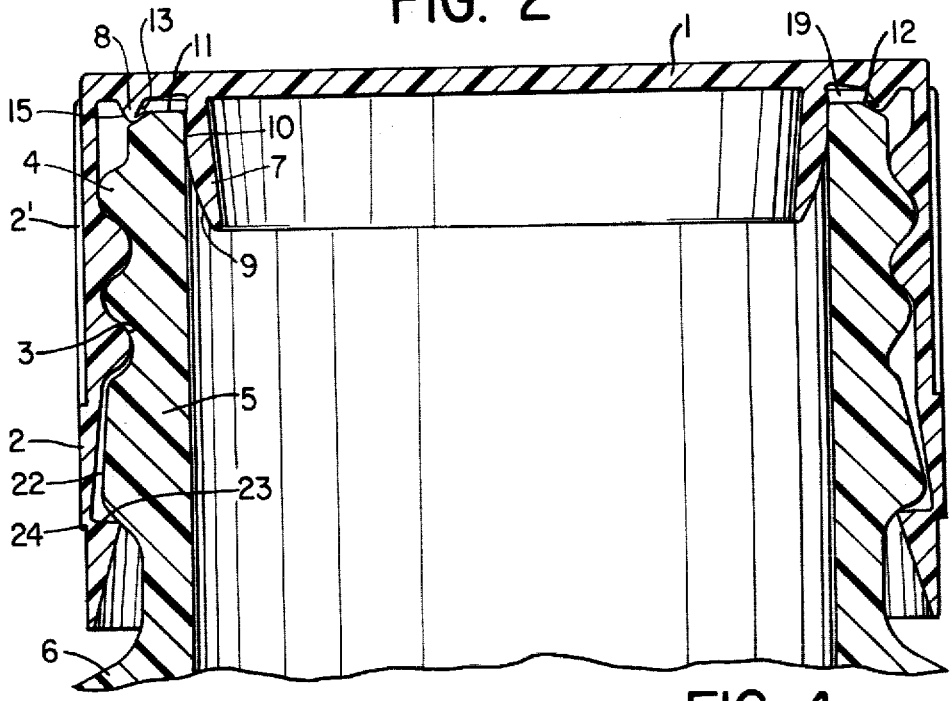
FIG. 2 is an enlarged cross-sectional view of the cap shown in FIG. 1 in fully threaded position on the neck of a bottle.
Figure 3:
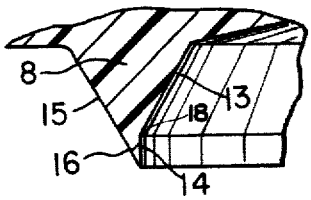
FIG. 3 is a greatly enlarged cross-sectional view of the outer annular seal of the cap in undistorted position.

The bottle cap as shown in FIGS. 1 and 2 includes a top wall 1, a cylindrical side wall 2 depending from the top wall and having an outer knurled surface 2' and a thread 3 on its internal surface. The thread is adapted to cooperate with an external thread 4 on the neck 5 of a bottle 6. For effecting sealing of the cap to the bottle, first and second flanges 7 and 8 are provided. Both of these flanges are annular in shape and extend downwardly from the top wall of the cap. The bottle cap shown in the drawings is a 28 mm cap and is constructed of suitable plastic such as polyethylene.

The first flange has an outer surface 9 which is convex in shape. The maximum diameter of this surface is greater than the inner diameter of the neck of the bottle so that, as the cap is threaded onto the bottle with this flange moving into the neck, it will flex radially inwardly to effect sealing against the inner surface 10 of the bottle neck.

The second sealing flange 8 is spaced radially outwardly of the first flange 7 and is oriented for engagement with the top surface 11 of the bottle neck at the outer periphery 12 thereof. This outer periphery is shown as being beveled. The second flange has a normal, generally triangular cross-sectional shape with inner and outer side walls extending downwardly from the top wall of the cap in a direction tapering toward each other. The inner wall includes an uppermost wall portion 13 extending toward the side wall 2 of the cap and a lowermost wall portion 14 extending axially of the side wall of the cap. The tip of the lowermost wall portion 14 intersects with the outer wall 15 of the flange to define a lower flange tip 16.

The outer wall 15 of the second flange is disposed at an angle of 45° with respect to the lowermost wall portion 14 of the inner wall. The uppermost wall portion 13 of the inner wall is, on the other hand, disposed at an angle of 30° with respect to the lowermost wall portion 14. The lower flange tip accounts for about ¼ of the height of the second flange from the inner surface 17 of the top wall of the cap. With a 28 mm cap, the total height of the second flange would be about 0.040 inches whereas the tip would be about 0.010 inches in length as measured in a direction extending downwardly from the inner surface 17. With a 28 mm cap, the inner wall surface 17 of the top which is disposed between the two flanges extends from the first flange toward the second flange in a direction downwardly from the top wall of the cap. The angle of inclination is about 7°.

Figure 4:
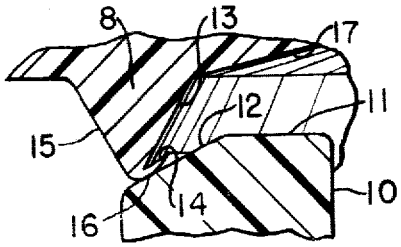
FIG. 4 is a greatly enlarged cross-sectional view of the outer sealing flange engaging the top of the bottle neck.

The plastic material from which the cap is constructed has a flexibility characteristic whereby the lower flange tip 16 of the second flange is sufficiently flexible so that, as it is engaged by the top beveled periphery 12 of the bottle neck, it will bend radially inwardly about the point of intersection 18 of the uppermost and lowermost surfaces 13, 14. The final position of the lower flange tip is shown most clearly in FIG. 4. It will be noted that this tip in effect provides a flapper type seal which, due to the resiliency of the plastic material, maintains a tendency to straighten out. Thus, the tip maintains a seal against the beveled periphery 12 which is over and above that which would be created by a simple face-to-face contact between the flange and the periphery 12. With a 28 mm cap, a proper seal along the periphery 12 of the top of the bottle neck is assured by constructing the lowermost wall portion 14 with a diameter of about 0.020 of an inch less than the diameter of the neck of the bottle. The orientation of the second flange and, in particular, the lower flange tip is such that it will abut the beveled periphery 12 of the top of the neck to provide a space 19 between the top of the bottle neck and the inner surface 17 of the top wall of the cap when the cap is fully threaded onto the bottle neck. In some cases, the beveled periphery 12 may be at a different angle from that shown in FIG. 4 whereby the top 11 will be at a higher elevation. Even under these circumstances, if this angle is such as to raise the top 11 sufficiently so that it contacts the inner surface 17 of the top of the bottle cap, engagement will be made along the inclined surface adjacent its intersection with the uppermost portion 13 of the second flange. Accordingly, a space will still be provided between the top 11 of the bottle neck and the inner surface 17 of the top of the cap.

As shown in FIG. 2, the spacing of the top of the bottle neck and the inner surface of the top of the bottle cap is bounded radially by the points of engagement of the first and second flanges 7 and 8 with the cooperating surfaces of the bottle neck. This in turn defines an annular chamber and this chamber is isolated from the interior of the bottle. The chamber further assists in providing an adequate seal of the cap to the bottle.

In addition to the sealing flanges of the cap, a tamper-proof ring 20 is provided at the lower end of the side wall of the cap. This ring has circumferentially spaced inner tapered wall sections 21 extending downwardly in a direction away from the top wall of the cap and radially outwardly toward the side wall. The wall sections 21 provide cam surfaces for riding over the outer surface of the bottle and, in particular, over the protuberance 22 formed on the outer surface of the bottle as the cap is threaded onto the bottle neck. The tapered wall joins with a radially outwardly extending ledge 23 at the upper end thereof. This ledge is adapted to engage under the protuberance 22 as the cap is fully threaded onto the bottle neck.

The tamper-proof ring is connected to the lower end of the side wall of the cap by frangible elements 24. These frangible elements are of a thickness whereby the initial threading of the cap onto the bottle neck can be effected without destroying these members. However, once the ledge 23 engages underneath the protuberance on the bottle, unthreading of the cap will cause these frangible elements to break thus providing, for the ultimate purchaser of the bottle, a telltale indication of whether or not the cap has been tampered with.

With the unthreading of the cap from the bottle, it will be recognized from FIG. 2 that the initial unthreading will cause the second flange to unseal from the periphery surface 12. As unthreading is continued, the inner seal will become weaker as the first flange reverts to its normal position and this weakened seal will permit the harmless escape of built up pressure from within the bottle before the cap reaches a condition where it would be blown off of the bottle with any projectile effect. Not only does the cap of the present invention provide good sealing, the construction is such that molding of the cap is possible without requiring a mold of delicate configuration. Thus, the mold may be used over extended periods of time without concern that any fragile or delicate parts will be damaged during handling.

I claim:

1. In a bottle cap for use with a bottle having a threaded neck opening into the bottle, said cap being constructed of flexible plastic material and having a top wall, a cylindrical side wall depending from the top wall and a thread on the inner surface of the side wall for cooperating with the thread on the neck of the bottle, the improvement comprising:

(a) a first annular sealing flange extending downwardly from said top wall for engagement with the wall surface of the bottle neck adjacent its opening into the bottle;

(b) a second annular sealing flange extending downwardly from said top wall outwardly of said first sealing flange for engagement with the top surface of the bottle neck, said second sealing flange normally having a generally triangular cross-sectional shape with inner and outer side walls extending downwardly from the top wall of the cap in a direction tapering toward each other and with the inner wall including an uppermost wall portion extending toward the side wall of the cap and a lowermost wall portion extending axially of the side wall of the cap until intersecting with the outer wall of the flange, said lowermost wall portion having an internal diameter slightly less than the outer diameter of the neck of said bottle and defining, with the adjacent portion of the outer side wall, a lower flange tip;

(c) said first and second sealing flanges being spaced from each other to seal against the cooperating surfaces of the bottle neck at spaced locations; and (d) said lower flange tip of the second flange being of sufficient flexibility to bend radially inwardly as it engages the top surface of the bottle neck.

2. The improvement in the bottle cap according to claim 1 for a bottle having the top surface of the neck beveled at its outer periphery, wherein:

(a) the outer wall of the second flange is disposed at an angle of 45° with respect to the lowermost wall portion of the inner wall;

(b) the uppermost wall portion of the inner wall is disposed at an angle of 30° with respect thereto; and (c) the lowermost wall portion of the inner wall amounts to about ¼ of the downward extension of the second flange.

3. The improvement in the bottle cap according to claim 2, wherein:

(a) the cap is constructed with the lowermost wall portion of the second flange having a diameter of about 0.020 of an inch less than the outer diameter of the neck of the bottle with which the cap is to be used.

4. The improvement in the bottle cap according to claim 3, wherein:

(a) the second flange is disposed to abut against the top surface of the bottle neck and to space the top surface from the inner surface of the top wall of the cap when the cap is fully threaded onto the bottle neck; and (b) the spacing between the top surface of the bottle neck and the inner surface of the top wall of the cap is bounded radially by engagement of the first and second flanges with the cooperating surfaces of the bottle neck to define an annular chamber isolated from the interior of the bottle.

5. The improvement in the bottle cap according to claim 4, wherein:

(a) the lower surface of the top wall extends between the first and second flanges in a radially outwardly direction away from the top wall.

6. The improvement in the bottle cap according to claim 5, wherein:

(a) the radial outer surface of the first flange is convex in shape with the maximum diameter thereof being greater than the inner diameter of the neck of the bottle; and (b) the first flange is flexible for flexing radially inwardly as the cap is threaded onto the bottle and the first flange inserted into the neck thereof so as to effect engagement of the outer surface of the first flange with the inner surface of the neck of the bottle.

7. The improvement in the bottle cap according to any one of claims 1-6, wherein:

(a) the cap further includes a tamper-proof ring at the end of the side wall for locking engagement with the exterior surface of the neck of the bottle upon threading of the cap onto the neck;

(b) said ring has an inner tapered wall extending downwardly in a direction away from the top wall of the cap and radially outwardly to provide a cam surface for riding over an outwardly extending protuberance on the neck of the bottle;

(c) said tapered wall joins with a radially outwardly extending ledge at the upper end thereof for engagement under the protuberance of the neck of the bottle after the cap is fully threaded thereon; and (d) frangible means connect said ring and the side wall of the cap, said means being constructed to withstand outward flexing of the ring as its cam surface rides over the protuberance on the bottle neck and to break as the cap is unthreaded from the neck of the bottle.

* * * * *